US005632511A

United States Patent [19]

Longtin et al.

[11] Patent Number: 5,632,511

[45] Date of Patent: May 27, 1997

[54] ID CARD-CARRIER COMBINATION PRODUCTION

[75] Inventors: Andre G. Longtin, Weare, N.H.; Michael D. Wilson, Dubuque, Iowa

[73] Assignee: Moore Business Forms, Inc., Grand Island, N.Y.

[21] Appl. No.: 329,253

[22] Filed: Oct. 26, 1994

[51] Int. Cl.[6] ..... B42D 15/00

[52] U.S. Cl. ..... 283/62; 283/81

[58] Field of Search ..... 283/62, 75, 81, 283/61, 100, 101; 40/299, 630, 638; 428/40, 41, 42, 43

[56] References Cited

U.S. PATENT DOCUMENTS

| | | | |
|---|---|---|---|
| 3,461,581 | 8/1969 | Hoffmann . | |
| 3,475,247 | 10/1969 | Freundlich . | |
| 4,890,862 | 1/1990 | Buchholz . | |
| 4,925,716 | 5/1990 | Haas . | |
| 5,096,229 | 3/1992 | Carlson . | |
| 5,131,686 | 7/1992 | Carlson . | |
| 5,198,275 | 3/1993 | Klein . | |
| 5,219,183 | 6/1993 | McKillip | 283/62 |

*Primary Examiner*—Willmon Fridie, Jr.
*Attorney, Agent, or Firm*—Nixon & Vanderhye P.C.

[57] ABSTRACT

An identification card-carrier combination is produced in a simple yet effective manner so that first and second cards are disposed side-by-side but are not directly connected to each other though positively positioned with respect to each other on a top face of the carrier, and readily releasable from the carrier. The combination includes a paper substrate having first length and width dimensions and a top face, the first and second identification cards disposed side-by-side and immediately adjacent to each other (e.g. abutting each other) and having a predetermined position with respect to each other, but unconnected directly to each other (the identification cards collectively have second width and length dimensions much less than the first dimensions), and an adhesive substrate common to the cards affixing the cards to the substrate web top face to hold the cards to the substrate web during printing and mailing while allowing removal of the cards from the substrate without damage to the cards. The adhesive substrate typically is a piece of double face pressure sensitive adhesive tape having width and length dimensions substantially the same the combined length and width dimensions of the first and second side-by-side cards. The combination may be in continuous format with perforations separating each set of first and second ID cards, or a number (e.g. three) of sets of cards may be provided on the same standard size office paper sheet (e.g. 8½×11 inches). Where the card sets are immediately consecutive (having a spacing of less than an inch) two different label applicators are used to apply the card sets, a first applicator applying the first and third sets and a second applicator applying the second set between the first and third sets.

20 Claims, 2 Drawing Sheets

Fig. 1
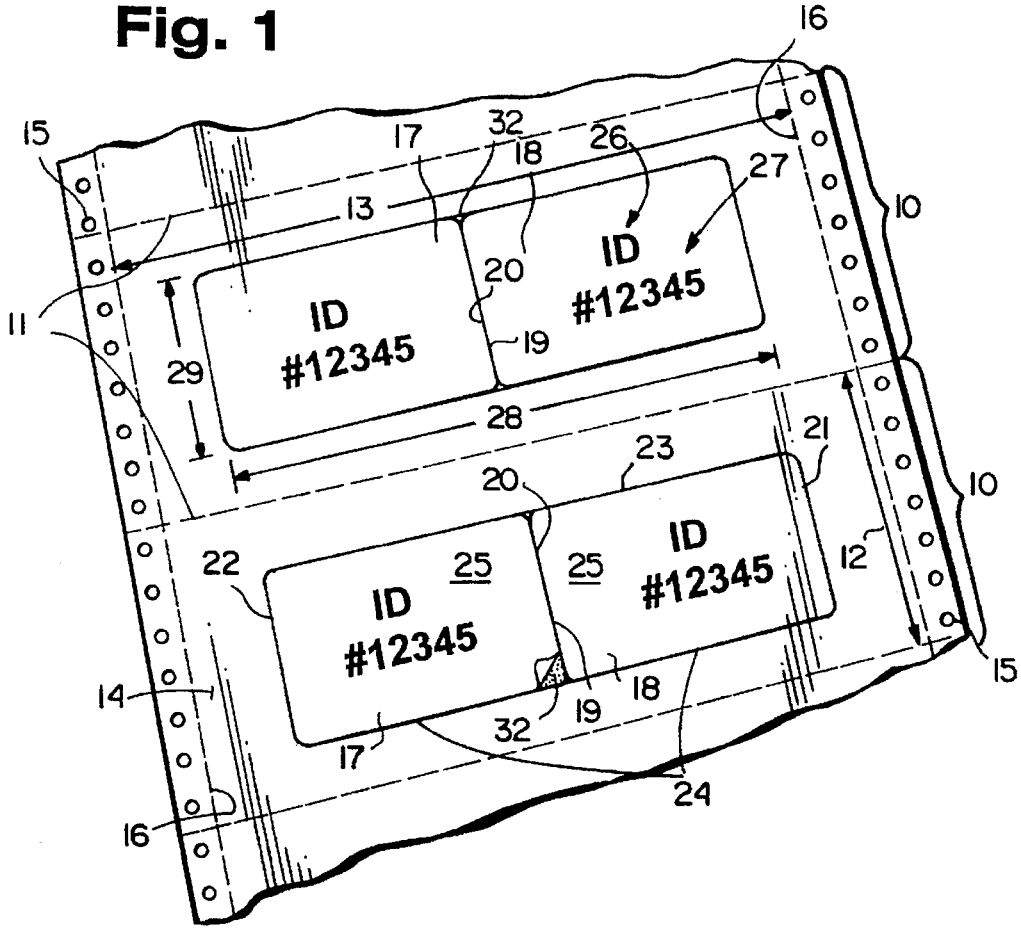
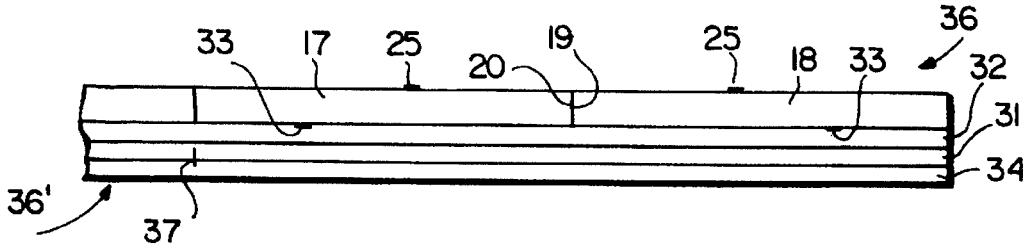
Fig. 2

ID CARD-CARRIER COMBINATION PRODUCTION

BACKGROUND AND SUMMARY OF THE INVENTION

Identification cards are becoming more and more common and are used by a wide variety of organizations. Identification cards may have a wide variety of uses, from club membership to credit authorization. Identification cards are typically either cut from carrier sheets or mounted on or in carrier sheets and mailed to recipients. Many times it is important to mail two (or more) ID cards to the same address, such as where two or more members of the household will need the ID cards. When doing so it is important that the cards be balanced on the carrier sheet, aesthetic, properly secured, and easily handled. While this can be ensured if the cards are die cut from the carrier sheet, one then relies upon the recipient to properly separate the cards from the carrier sheet, and such a procedure is not practical where the carrier sheet and the card are ideally made of different materials, or different weight materials. For exemplary prior art see U.S. Pat. No. 5,131,686 which shows two ID cards die cut from the same substrate and connected to each other with ties, as well as two separate cards separately applied to a carrier web with adhesive.

In the past when it has been necessary to provide two ID cards on a carrier sheet usually two separate cards were affixed to the sheet in different mounting procedures. However this required two affixing units to apply the cards to the sheet, the number of mounting applications was doubled, and it was difficult to ensure properly relative positioning of the cards which could be off as much so as one-eighth inch leading to problems in print position when the cards were subsequently passed through a printer for applying variable indicia thereto, and in the appearance of the cards in a mailer.

In some situations it is also necessary to apply different card sets to the same carrier standard size office paper sheet. If the cards are mounted too close to each other it is not possible to apply them in a high production manner, or would require four label applicators to do so.

According to the present invention the problems discussed above have been solved. By the present invention it is possible to mount two (i.e. at least two) ID cards on a common carrier so that they are positively positioned in the desired spacial relationship with respect to each other (typically immediately side-by-side with side edges abutting, but not directly connected to each other). This can be accomplished, according to the present invention, in a simple and high production manner utilizing only one applicator if the card sets are spaced a significant distance (e.g. at least about an inch) with respect to each other, or using only two applicators if spaced very closely to each other (e.g. less than an inch).

According to one aspect of the present invention an identification card-carrier combination is provided comprising: A substrate web having first length and width dimensions, and a top face. First and second identification cards disposed side-by-side and immediately adjacent to each other and having a predetermined position with respect to each other, but unconnected directly to each other. The identification cards, collectively, have second width and length dimensions much less than the first length and width dimensions. And, an adhesive substrate common to the first and second identification cards affixing the cards to the substrate web top face to hold the cards to the substrate web during printing and mailing while allowing removal of the cards from the substrate web without damage to the cards.

Typically the adhesive substrate comprises a piece of double faced pressure sensitive adhesive tape having width and length dimensions substantially the same as the combined length and width dimensions of the first and second side-by-side cards. Alternatively one pattern of adhesive can be applied to a substrate web so that it is exposed on the top face thereof and then the side-by-side ID card connected by repositional adhesive to a common intermediate web may be applied to the adhesive pattern on the substrate web.

The combination as set forth above may be in continuous format with a plurality of like substrate webs, each substrate web separated from each adjacent substrate web by a line of weakness, such as a perforation line. In that case tractor drive strips are typically disposed on opposite sides of the continuous format of substrate webs extending perpendicular to the lines of weakness, and severable from the body of the carrier by their own lines of weakness.

Alternatively, the web substrate may comprise a cut size standard office paper sheet. The term "standard size office paper sheet" includes 8½×11 inch, legal size, and A4, or other standard sizes to be developed in the future. In either configuration the cards are preferably mounted so that a side edge of the first card of each set substantially engages (abuts) a side edge of the second card while the front and rear edges of the first card are aligned with the front and rear edges of the second card.

When a cut standard size office paper sheet is utilized a plurality of first and second card sets may be disposed on the sheet with the side edges of the cards parallel to the side edges of the sheet and the front and rear edges of the cards parallel to the front and rear edges of the sheet, with the front or rear edge of a card of one card set spaced from the adjacent rear or front edge of an adjacent card set at least about 0.15 inches, but also typically less than about one inch. Lines of weakness, such as perforations, are provided parallel to the front and rear edges and disposed between the sets of cards separating the sheet into a plurality of rectangular-shaped panels each having substantially identical width and length dimensions. The cut shape may include at least three sets of cards (typically three sets on an 8½×11 sheet) and a lead-in panel may be provided for the sheet having the same width as the card carrying panels and having a length at least as great as the length of the card carrying panels, the lead-in panel devoid of cards.

According to another aspect of the present invention a method of producing and utilizing first and second substantially identical identification cards each having top and bottom faces in combination with a carrier having a top face is provided. The method utilizes double faced pressure sensitive adhesive tape having top and bottom adhesive faces, so that the cards are not directly connected to each other, positively positioned with respect to each other on the carrier top face. The method comprises the steps of: (a) Automatically moving a carrier in a first direction so that the top face thereof is exposed. (b) Mounting the first and second identification cards so that they are directly unconnected to each other but in side-by-side relationship, with the bottom faces of each releasably affixed to and positively positioned on the double faced adhesive tape top face. And, (c) automatically applying the double faced adhesive tape bottom face adhesive to the carrier top face so that the tape and carrier adhere to each other, to produce a carrier-dual identification card combination.

Typically there is also the further step (d), after step (c), of passing the carrier through a printer (e.g. a laser printer)

and printing variable indicia (such as an ID number, the cardholder's name, address, and/or identifying numbers, etc.) on the top face of the cards with the printer. There is also typically the further step (e), between steps (c) and (d), where the carrier is a continuous paper web, of taking up into a roll the continuous carrier with a plurality of identification card set affixed thereto, the roll eventually cut into pads and sheets before printing, or printed in continuous format, with ultimate separation and mailing of the sets of ID cards (i.e. after printing).

Steps (a) through (c) may be practiced to provide a plurality of sets of first and second identification cards, the cards of adjacent sets spaced a distance of less than one inch from each other in the first direction, and by utilizing first and second label applicators spaced from each other in the first direction. In that case step (c) is practiced by applying first and third card sets to the carrier utilizing the first label applicator and applying a second card set, between the first and third card sets in the first direction, utilizing the second label applicator. The carrier may comprise a standard size office paper sheet, and steps (a) through (c) may be practiced to provide a lead-in portion of the sheet devoid of cards and having a dimension in the first direction at least as great as the dimension of a card set in the first direction. There is also typically the step of forming lines of weakness in the carrier between adjacent card sets, the lines of weakness perpendicular to the first direction.

It is the primary object of the present invention to provide for the effective, simple, and high capacity production of identification card-carrier combinations having first and second identification cards disposed side-by-side and immediately adjacent to each other but unconnected directly to each other, and the methods of production thereof. This and other objects of the invention will become clear from an inspection of the detailed description of the invention and from the appended claims.

BRIEF DESCRIPTION OF THE DRAWINGS

FIG. 1 is a schematic top perspective view of a continuous format paper web substrate having a plurality of substrate web carrier-card combinations according to the invention with first and second identification cards disposed side-by-side immediately adjacent to each other, but unconnected directly to each other, on the substrate web;

FIG. 2 is an end view, with the components greatly enlarged for clarity of illustration, of a set of ID cards, and part of a second set to which the set of ID cards is connected, prior to application to a substrate web;

DETAILED DESCRIPTION OF THE DRAWINGS

Figure 3:
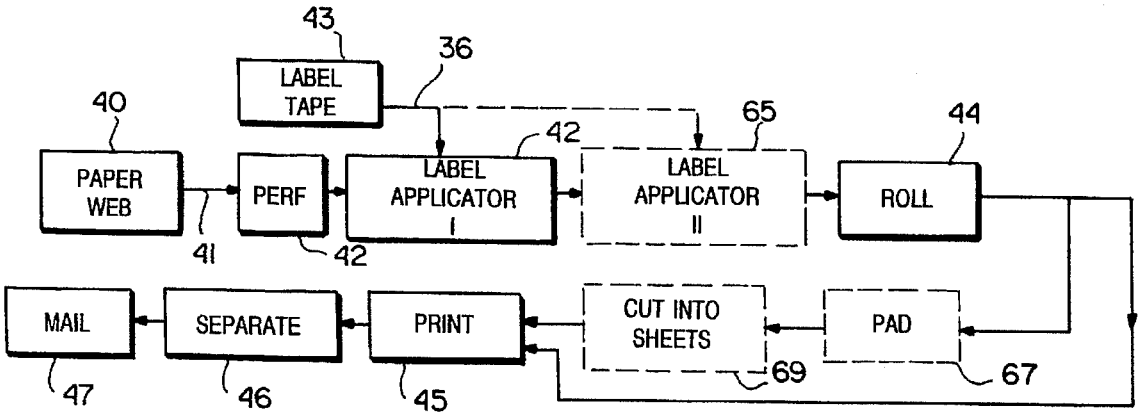
FIG. 3 is a schematic box diagram illustrating exemplary method steps that may be utilized in the practice of a method according to the present invention.

FIG. 1 shows a continuous format of exemplary substrate webs 10 according to the present invention, substrate webs 10 in the continuous format being separated from each other by perforation lines 11, or other lines of weakness. Each substrate web 10 has first length 12 and width 13 dimensions, and a top face 14. In the continuous format tractor drive strips 15 are typically provided along the side edges of the web substrates 10, and the tractor drive strips 15 are also typically separated from the web substrates by lines of weakness (e.g. perforations) 16.

On each web substrate 10 are provided first and second identification cards 17, 18, disposed in side-by-side relationship and immediately adjacent to one another and having a predetermined position with respect to each other, but unconnected directly to each other. Preferably the cards 17, 18 are mounted—as illustrated in FIGS. 1 and 2—so that side edges 19, 20 thereof substantially abut each other, but are not connected to each other by ties or the like. The side edges 19, 20 are parallel to the other side edges 21, 22 of the ID cards 17, 18, the cards being substantially quadrate in configuration, while the side edges 19 through 22 are essentially perpendicular to the front edges 23 and rear edges 24 of the cards 17, 18, the edges 23, 24 of the cards 17, 18 being aligned with each other, and parallel to the perforation lines 11.

The ID cards 17, 18 may be made of plastic, paper, paperboard, or other suitable materials as is conventional. They include top faces 25 on which indicia may be provided, such as a non-variable indicia 26 and the variable (from one card set to another) indicia 27 illustrated in FIG. 1.

Note that the identification cards 17, 18 of a set, collectively, have a width dimension 28 which is much less than (at least 10% less than) the width dimension 13 of the web substrate 10, and length dimension 29 much less (e.g. at least about 10% less) than the length dimension 12 of the web substrate 10.

An adhesive substrate common to the first and second cards 17, 18 affixes the card 17, 18 to the substrate web 10 top face 14 to hold the cards 17, 18 to the substrate web 10 during printing and mailing while allowing removal of the cards 17, 18 from the substrate web 10 without damage to the cards 17, 18. In the preferred embodiment illustrated in FIG. 2, the adhesive substrate comprises a piece of double faced adhesive tape 31 of conventional material and construction, e.g. transparent plastic or cellophane strip or film. On the top face of the tape 31 is pressure sensitive adhesive 32, preferably repositional adhesive such as CLEAN-TAC® adhesive from Moore Business Forms, Inc. of Lake Forest, Ill., although some types of "permanent" or removable adhesive may be used for plastic cards 17, 18, which will separate without damage. Adhesive 32 adheres to the bottom faces 33 of the cards 17, 18. While the repositional adhesive 32 properly holds the cards 17, 18 in place during printing and mailing, it allows ready removal of the cards therefrom. The tape 33 also includes on the opposite face thereof pressure sensitive adhesive 34, which may be permanent, removable, or repositional pressure sensitive adhesive, but in any event it has a higher affinity for the top face 14 of the web substrate 10 and for the tape 31 than the bottom face 33 of the cards 17, 18 have for the adhesive 32.

Note that the tape 31 extends substantially the entire width and length of the side-by-side cards 17, 18, holding them together during application of the entire assembly 36 illustrated in FIG. 2 to the web substrate 10.

Note that the entire assembly 36 prior to dispensing thereof and application to the web substrate 10 is preferably in a roll or other continuous form, connected to like assemblies 36' for example by perforation lines 37 in the tape 31.

While the adhesive substrate in the form of the double faced pressure sensitive adhesive tape 31 is preferred, other constructions of adhesive substrate may be provided. For example a pattern coat of a chemical adhesive may pre-exist on the substrate 10 to which the strip 31 (without the chemical adhesive 34) may be applied, and/or the adhesives may—instead of chemical adhesives—be electrostatic, or other types, as long as they function in basically the same manner as described above.

FIG. 3 schematically illustrates a method that may be utilized to produce the card-carrier combination illustrated in FIG. 1. As indicated by box 40, a paper web is substantially continuously moved in a first direction 41 so that the top face (14 in FIG. 1) thereof is exposed. The paper web may have the tractor drive strips (15 in FIG. 1). Perforations, or like lines of weakness, are applied to the web as indicated at conventional perf station 42, the perforations being illustrated at 11 in the exemplary embodiment of FIG. 1. The web is fed to the label applicator 42, which also receives "label tape"—such as the assembly 36 illustrated in FIG. 2—from the label tape supply (e.g. roll) 43. For example the label applicator 42 may comprise a Quadrel label unit model #0S152, available from Quadrel Labelling Systems of Willoughby, Ohio. The label applicator 46 places the entire assembly 36 onto the top face 14 of the paper web so that the adhesive 34 sticks to the top face 14 and the cards 17, 18 are positively positioned with respect to each other, and the web substrate 10, as illustrated in FIG. 1.

After the ID cards 17, 18 are applied—assuming that the sets of cards 17, 18 are spaced from each other in the direction 41 at least about an inch (as is the case in the FIG. 1) they are then taken up in a roll configuration, by a conventional roll take-up as illustrated schematically at 44 in FIG. 3. Then they are ultimately fed through a printer, such as a laser printer, 45, which applies the variable indicia 27 to the top face 25 of the cards 17, 18. Because the cards 17, 18 are properly positioned with respect to each other and the web substrate 10, the variable indicia 27 will also be accurately positioned on the card top faces 25. Any non-variable indicia may also be applied by printer 45, but could have alternatively been applied (on both or either face 33, 25 of the cards 17, 18) prior to the assemblies 36 being formed (prior to station 43).

Ultimately, the web substrates 10 are typically separated from each other along the perforation lines 11 by conventional separating equipment as illustrated schematically at 46 in FIG. 3, and then mailed (e.g. inserted into envelopes or packages), as illustrated schematically at 47 in FIG. 3.

Figure 4:
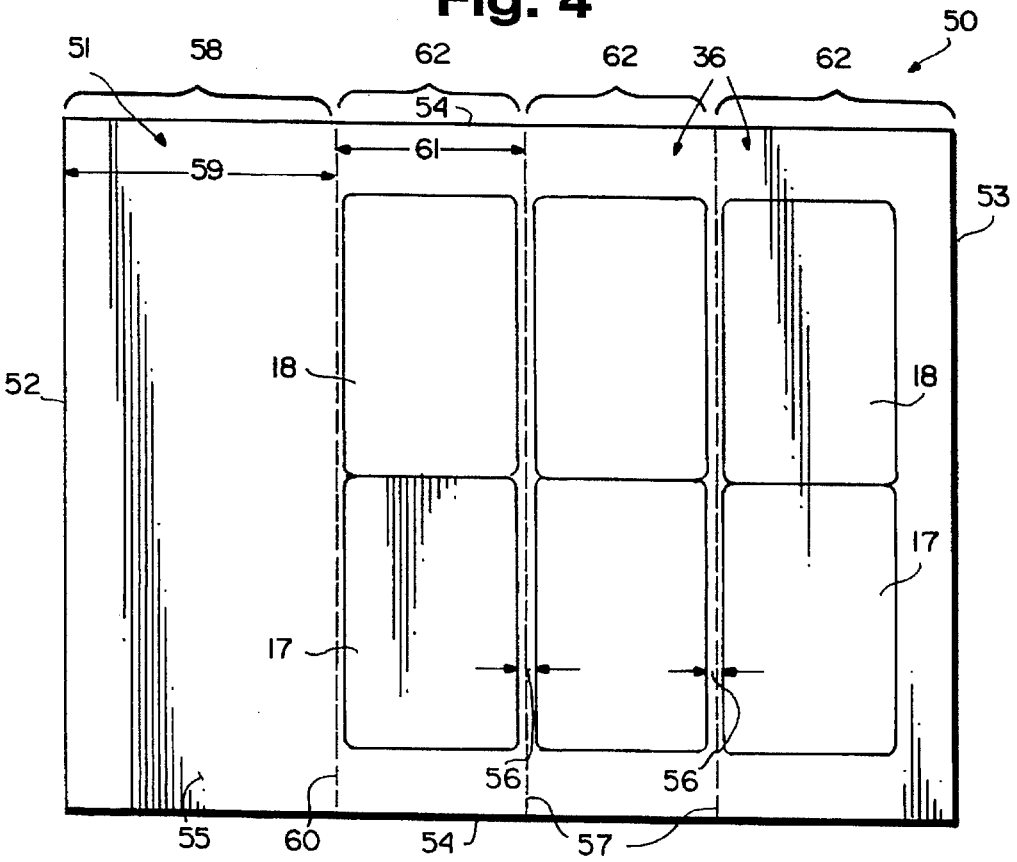
FIG. 4 is a top plan view of a cut sheet embodiment of a card-carrier intermediate combination according to the invention prior to feeding to a printer, and with a plurality of card sets very closely spaced to each other.

FIG. 3 also illustrates in dotted line various other pieces of equipment/method steps that may be utilized to produce another modification of a card-carrier combination according to the invention, such as a card/carrier combination illustrated schematically at 50 in FIG. 4.

In the embodiment of FIG. 4, the cut sheet 51 is preferably of a standard size office paper, such as 8½×11 inch, legal size, or A4, having a leading edge 52, a rear edge 53, and side edges 54. The side edges 54 are parallel to each other and perpendicular to the front and rear edges 52, 53. A plurality of sets of ID cards 17, 18 (each preferably provided by applying an assembly 36 to the top face 55 of sheet 51) are provided, each of the assemblies 36 and the ID cards 17, 18 associated therewith spaced from each other in the direction 41 (FIG. 3) a distance 56. The distance 56 is—in this embodiment—significantly less than an inch, but more than about 0.15 inches, and typically a perforation line—or other line of weakness—57, parallel to the front and trailing edges 52, 53, is provided substantially bisecting the distance 56.

The carrier-card combination 50 also preferably includes a lead-in panel 58 which has a length—the dimension 59, between the lead edge 52 and the perforation line 60—which is at least as great as (and preferably slightly greater than) the length dimension 61 of each of the card carrying panels 62 (which preferably have approximately the same dimensions). The construction of FIG. 4 is provided—that is where the card set 17, 18 are not symmetrically placed on the sheet 51 along its entire length—so that the lead-in panel 58 has sufficient dimensions to allow the combination 50 to be pulled through a conventional printer (e.g. a HP laser jet 4M desktop laser printer) while still carrying six cards 17, 18.

In the construction of the combination 50, however, it is very difficult if not impossible using the same applicator to apply all three sets of cards 17, 18 since they are so close to each other (have such a small spacing 56). Therefore to produce the combinations 50 a second label applicator 65 illustrated in FIG. 3 is utilized. The applicator 65 is essentially the same as the applicator 42 and is downstream thereof in the first direction 41. The first applicator 42 applies—in one preferred embodiment of the invention—the first and third sets of cards 17, 18 (from the leading edge 52 toward the trailing edge 53), while the second applicator 65 applies the second set of cards 17, 18, in between the other steps, as illustrated in FIG. 4 [and the fourth set, if one exists].

The combination 50 also is typically manufactured utilizing the additional pieces of apparatus/method steps illustrated in FIG. 3 in dotted line including the pad forming stage 67 and the stage 69 in which the cut sheets 51 are formed (the edges 52, 53 perpendicular to the direction 41).

It will thus be seen that according to the present invention an advantageous identification card-carrier combination, and method of producing and utilizing a multiple identification card/carrier assembly, have been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent products and processes.

What is claimed is:

1. An identification card-carrier combination, comprising:

a substrate web having first length and width dimensions, and a top face;

first and second identification cards disposed side-by-side and immediately adjacent to each other having a predetermined position with respect to each other, but unconnected directly to each other;

said identification cards, collectively, having second width and length dimensions much less than said first length and width dimensions; and an adhesive substrate common to said first and second identification cards affixing said cards to said substrate web top face to hold said cards to said substrate web during printing and mailing while allowing removal of said cards from said substrate web without damage to said cards, said adhesive substrate comprising a piece of double face pressure sensitive adhesive tape having width and length dimensions substantially the same as the combined length and width dimensions of said first and second side-by-side cards.

2. A combination as recited in claim 1 in continuous format with a plurality of like substrate webs, each substrate web separated from each adjacent substrate web by a line of weakness.

3. A combination as recited in claim 2 further including tractor drive strips on opposite sides of said continuous format of substrate webs, said tractor drive strips extending perpendicular to said lines of weakness.

4. A combination as recited in claim 1 wherein said pressure sensitive adhesive of said double face tape engaging said cards comprises repositional adhesive.

5. A combination as recited in claim 1 wherein said cards are plastic.

6. A combination as recited in claim 1 wherein said cards have width-extending parallel side edges and length-extending front and rear edges, said side edges each having a dimension significantly less than a dimension of either of said front and rear edges; and wherein said cards are mounted so that a side edge of said first card substantially engages a side edge of said second card while said front and rear edges of said first card are aligned with said front and rear edges of said second card.

7. A combination as recited in claim 6 wherein said web substrate comprises a cut standard size office paper sheet having parallel side edges and parallel front and rear edges; and further comprising a plurality of said first and second card sets disposed on said standard size office paper size sheet with said side edges of said cards parallel to said side edges of said sheet and said front and rear edges of said cards parallel to said front and rear edges of said sheet, and said front or rear edge of a card of one card set spaced from the adjacent rear or front edge of an adjacent card set at least about 0.15 inches.

8. A combination as recited in claim 7 further comprising lines of weakness parallel to said front and rear edges and disposed between said sets of cards, separating said sheet into a plurality of rectangular-shaped panels each having substantially identical width and length dimensions.

9. A combination as recited in claim 8 wherein said sheet includes at least three sets of cards and wherein the spacing between the adjacent front or rear edges of cards in adjacent sets is less than one inch, and further comprising a lead-in panel of said sheet having the same width as said card-carrying panels and having a length at least as great as the length of said card-carrying panels; said lead-in panel devoid of cards.

10. An identification card-carrier combination, comprising:

a substrate web having first length and width dimensions, and consisting of a single thickness and having a top face;

first and second identification cards disposed side-by-side and immediately adjacent to each other having a predetermined position with respect to each other, but unconnected directly to each other;

said identification cards, collectively, having second width and length dimensions much less than said first length and width dimensions and having free front and rear edges, unconnected to other structures; and a pressure sensitive adhesive substrate common to said first and second identification cards affixing said cards on top of said substrate web top face to hold said cards to said substrate web during printing and mailing while allowing removal of said cards from said substrate web without damage to said cards.

11. A combination as recited in claim 10 wherein said cards have width-extending parallel side edges and length-extending front and rear edges, said side edges each having a dimension significantly less than a dimension of either of said front and rear edges; and wherein said cards are mounted so that a side edge of said first card substantially engages a side edge of said second card while said front and rear edges of said first card are aligned with said front and rear edges of said second card.

12. A combination as recited in claim 11 wherein said web substrate comprises a cut standard office paper size sheet having parallel side edges and parallel front and rear edges; and further comprising a plurality of said first and second card sets disposed on said standard office paper size sheet top face with said side edges of said cards parallel to said side edges of said sheet and said front and rear edges of said cards parallel to said front and rear edges of said sheet, and said front or rear edge of a card of one card set spaced from the adjacent rear or front edge of an adjacent card set at least about 0.15 inches.

13. A combination as recited in claim 12 further comprising lines of weakness parallel to said front and rear edges and disposed between said sets of cards, separating said sheet into a plurality of rectangular-shaped panels each having substantially identical width and length dimensions.

14. A combination as recited in claim 13 wherein said sheet includes at least three sets of cards and wherein the spacing between the adjacent front or rear edges of cards in adjacent sets is less than one inch, and further comprising a lead-in panel of said sheet having the same width as said card-carrying panels and having a length at least as great as the length of said card-carrying panels; said lead-in panel devoid of cards.

15. An identification card-carrier combination as recited in claim 1 wherein said substrate web consists of a single thickness paper web having said top face.

16. A combination as recited in claim 1, and wherein a plurality of card sets are disposed on said top sheet; and further comprising lines of weakness parallel to said card front and rear edges and disposed between said sets of cards, separating said web into a plurality of rectangular-shaped panels each having substantially identical width and length dimensions.

17. A combination as recited in claim 15 wherein said pressure sensitive adhesive of said double faced tape engaging said cards comprises repositional adhesive, wherein said cards are plastic.

18. A combination as recited in claim 10 wherein said pressure sensitive adhesive comprises repositional adhesive, wherein said cards are plastic.

19. A combination as recited in claim 10, and wherein a plurality of card sets are disposed on said top sheet; and further comprising lines of weakness parallel to said card front and rear edges and disposed between said sets of cards, separating said web into a plurality of rectangular-shaped panels each having substantially identical width and length dimensions.

20. A combination as recited in claim 18 wherein said substrate web is paper.

* * * * *